US005496091A

United States Patent [19]

Karl et al.

[11] Patent Number: 5,496,091

[45] Date of Patent: Mar. 5, 1996

[54] CHAIR AND GROUPING THEREOF

[75] Inventors: Richard B. Karl, St. Charles; Harvey Hanig, North Aurora, both of Ill.

[73] Assignee: Norix Group, Inc., West Chicago, Ill.

[21] Appl. No.: 213,161

[22] Filed: Mar. 14, 1994

[51] Int. Cl.[6] ..... A47C 15/00

[52] U.S. Cl. ..... 297/248; 297/249; 297/DIG. 2; 297/452.65; 297/188.13

[58] Field of Search ..... 297/248, 249, 297/232, 243, 244, 257, 188.01, 188.08, 188.09, 188.13, 440.14, 452.17, 452.65, 452.1, DIG. 2, 452.14, 440.1, 233; 248/501

[56] References Cited

U.S. PATENT DOCUMENTS

| | | | |
|---|---|---|---|
| 123,131 | 1/1872 | Taylor | 297/249 |
| 3,556,586 | 1/1971 | Beardmore | 297/DIG. 2 X |
| 3,584,916 | 6/1971 | Bayes | 297/249 X |
| 3,774,962 | 11/1973 | Watamura et al. | 297/249 |
| 3,841,701 | 10/1974 | Sullivan | 297/248 |
| 3,899,210 | 8/1975 | Samhammer et al. | 297/452.17 X |
| 4,213,213 | 7/1980 | Burnett | 297/452.17 X |
| 4,929,021 | 5/1990 | Kaye | 297/188.09 |
| 4,988,090 | 1/1991 | Schmitt | 472/116 |
| 5,352,017 | 10/1994 | Berning | 297/248 |

FOREIGN PATENT DOCUMENTS

| | | | |
|---|---|---|---|
| 185619 | 5/1907 | Germany | 297/248 |
| 2021716 | 1/1972 | Germany | 297/DIG. 2 |
| 2846750 | 4/1980 | Germany | 297/440.1 |

*Primary Examiner*—Milton Nelson, Jr.
*Attorney, Agent, or Firm*—Mathew R. P. Perrone, Jr.

[57] ABSTRACT

A hollow chair may hold an amount of weight due to a flowable material contained therein and may be joined to on or more chairs.

19 Claims, 5 Drawing Sheets

CHAIR AND GROUPING THEREOF

This invention relates to a chair and more particularly to a chair or grouping thereof, especially suitable for use in an incarceration facility.

BACKGROUND OF THE INVENTION

It is desirable that furniture have durability. It is also desirable that furniture be suited for the purpose desired as well as aesthetically pleasing. An especially difficult situation is to develop furniture suitable for use in incarceration facilities or correctional facilities.

Other locations requiring a durable, aesthetically pleasing chair are clear. Any location having a heavy concentration of people requires a durable, aesthetically pleasing chair. Other such locations are typified by a college lounge, a hospital, and an airport lounge. So it is clear for the purposes herein that a reference to an correctional facility can include other sites.

Furniture for incarceration facilities or correctional facilities has special requirements. This location almost definitely precludes the use of foam or upholstery to achieve the comfort. Among the other defined reasons to avoid use of upholstery or foam in prison furniture, an additional reason is to provide an easily cleaned piece of furniture.

Durability and suitability as well as comfort, aesthetical and ergonomical utility are required. It is difficult to achieve proper aesthetics and ergonomics or comfort, when the primary goal is durability and suitability.

Furthermore, it is desired that furniture used in a correctional facility permit no improper use of that furniture, by anyone incarcerated therein. For example, any furniture must lack a place of concealment. Typically, an inmate will try to conceal a drug, a weapon or other contraband in furniture. An inmate may also try to make a weapon from a part of the furniture. The structure of the furniture must avoid all of these problems.

Additionally, mobility or ease of correctional facility furniture movement is required. This mobility, however, must be combined with the ability to fix the piece of furniture in place. It is best desired to have incarceration furniture mobile, but capable of being made immobile in a relatively simple fashion.

Clearly, furniture used in incarceration facilities must be durable with a long life cycle, in order to survive the heavy use received therein. It must also be easily cleaned.

If the durability, can be combined with aesthetically pleasing characteristics, certain psychological advantages can be obtained. For one, the aesthetic pleasure with corresponding comfort can reduce the mental strain on both the prisoners and the staff. This factor can inherently result in a safer environment.

These factors are especially required for a chair to be used in a correctional facility. Another factor useful for a correctional facility chair is the ability of the chair to be joined to another chair. If this can be accomplished, the chair can serve a number of different functions.

It is also especially useful, if the chair can be made difficult to lift or move. Also a removable part of the furniture must be avoided. Such limitations keep the chair or a part thereof from becoming a weapon in the event of a riot or other undesired occurrence.

Other requirements of incarceration facility furniture include difficulty in a making a weapon from a chair Thus, it may be seen that there are a number of conflicting design requirements when incarceration facility furniture is considered. To maximize the advantages of these conflicting requirements can create a major problem.

SUMMARY OF THE INVENTION

Among the many objectives of this invention is the provision of a chair which can be rotationally molded to have a proper shape for comfort and aesthetics, while being durable and mobile when desired.

Another objective of this invention is to provide a chair, which is easily attached to another chair of the same type.

Yet another objective of this invention is to provide a chair, which can be weighted.

Still another objective of this invention is to provide a chair, which is suitable for use in a correctional facility.

Additionally, an objective of this invention is to provide a chair, which is durable.

Also, an objective of this invention is to provide a chair, which is aesthetically pleasing.

A further objective of this invention is to provide a chair, which is easily installed.

A still further objective of this invention is to provide a chair, which can easily have substantial weight added thereto.

Yet a further objective of this invention is to provide a chair, which is easily moved.

Another objective of this invention is to provide a chair, which is easily attached or secured in position.

Yet another objective of this invention is to provide a chair, which is difficult to use as a weapon.

Still another objective of this invention is to provide a chair, which lacks a place of concealment.

Additionally, an objective of this invention is to provide a chair, which is tamperproof.

Also, an objective of this invention is to provide a chair, which is fire retardant.

A further objective of this invention is to provide a method for attaching a chair to another chair of the same type.

A still further objective of this invention is to provide a method for adding weight to a chair.

Yet a further objective of this invention is to provide a chair, which is easily cleaned.

Another objective of this invention is to provide a chair, which is comfortable even in the absence of foam.

Yet another objective of this invention is to provide a chair, which is comfortable even in the absence of upholstery.

These and other objectives of the invention (which other objectives become clear by consideration of the specification, claims and drawings as a whole) are met by providing a chair which is hollow and capable of holding an amount of weight on the interior thereof and being joined to a second chair.

BRIEF DESCRIPTION OF DRAWINGS

Throughout the figures of the drawings where the same part appears in more than one figure the same number is applied thereto.

DESCRIPTION OF PREFERRED EMBODIMENTS

The chair of this invention is a shaped one piece chair. Formation of the chair is accomplished by any suitable, but preferably by a rotational molding process. This chair may be joined to another chair or chairs of the same type in order to form a desired grouping.

It has an ergonomically shaped seat and back along with appropriate indentations to permit simplified molding while providing a chair, which is strong, durable and comfortable. The chair has a back support and seating mechanism combined with straight arms.

In the base of the chair thereof are three edge indentations, one each being on the rear and two side portions. Within these edge indentations are threaded members to provide for attachment of plates, which can secure one chair to another as many times as desired.

Centrally located in the base of the chair is a plug, the removal of which provides access to the interior of the chair. The base location is critical in order to restrict access to plug for storage of common prison contraband.

Into that plug may be inserted a bag. The bag may have sand, or a similar material inserted therein. The bag may then be sealed and the plug closed. This sand or similar heavy material can provide weight to the chairs and make the chair difficult, if not impossible, to move. In this fashion, the desired results can be obtained for a chair or group thereof suitable for use in an incarceration facility.

The chairs are heavy duty and durable. Also, the chairs are not easily damaged. The chairs may be formed by rotational molding in a relatively simple fashion. By such molding, the chairs are then formed as hollow chairs.

The formation of an aperture in the base of the chair permits an access to the interior of the molded, hollow chair. Such access permits a bag to be inserted into the chair's interior. The bag, while optional, adds to neatness desired for the system.

Whether there is a bag in the interior or not, a flowable material capable of providing great weight when contained may be added to the chair. Typical of the flowable material is sand or other weight material. It is also feasible to insert the sand or other weight material directly into the chairs. However, the bag is preferred especially for the sand with the idea being neatness and more efficient insertion of the sand.

Figure 1:
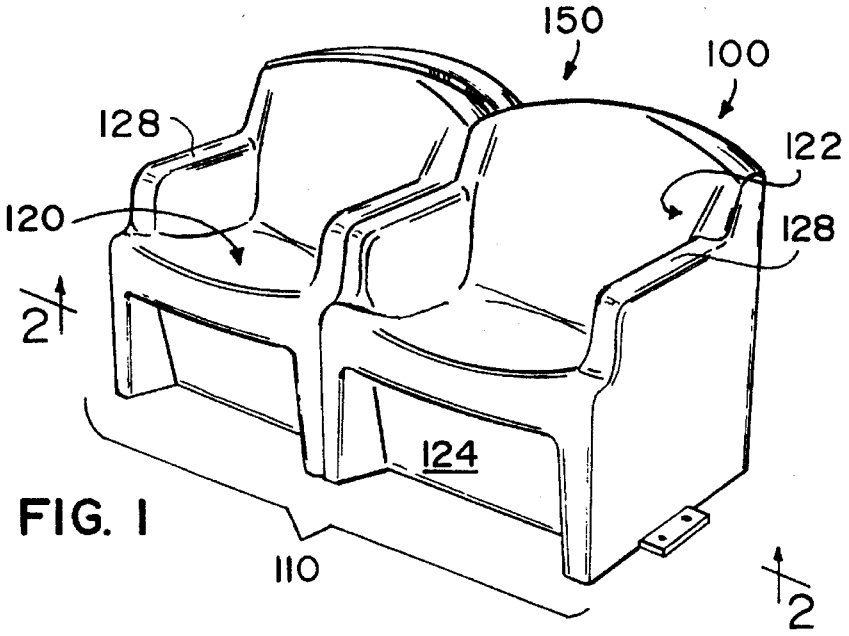
FIG. 1 depicts a front top, perspective view of two of the correctional facility chair 100 of this invention.

Referring now to FIG. 1, a chair 100 of this invention is shown as double grouping 110. Chair 100 is a shaped, one-piece chair. Formation of the chair 100 to create the desired hollow aspect is best accomplished by a rotational molding process. This chair 100 may be joined to another chair 100 or chairs of the same type in order to form a desired grouping.

Figure 2:
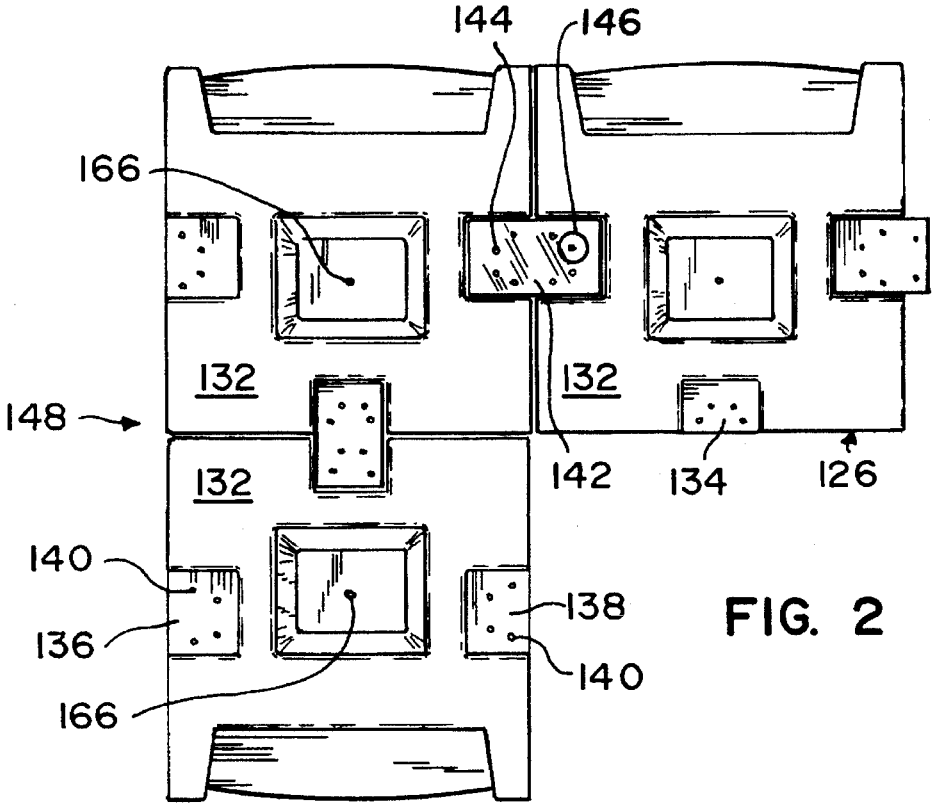
FIG. 2 depicts a bottom, plan view of two correctional facility chairs to of this invention.

Adding FIG. 2 to the consideration, in the base 132 thereof are three edge indentations, one being a rear indentation 134 adjacent the back 126, and a first side indentation 136 adjacent one arm rest 128 with a second side indentation 138 adjacent the other arm rest 128. Within these edge indentations are mounted female threaded members 140 to provide for attachment of straight plate 142.

The three edge indentations, the rear indentation 134, the first side indentation 136 and the second side indentation 138 are all generally rectangular in shape. Each receives straight plate 142 in a relatively tight, slidable fit.

Straight plate 142 includes a plate aperture 144 for each female threaded member 140, which lines up appropriately due to the tight fit. Each plate aperture 144 can receive a bolt 146, which can secure one chair 100 to another as many times as desired. Both a back to back structure 148 and a side to side structure 150 is shown.

Figure 3:
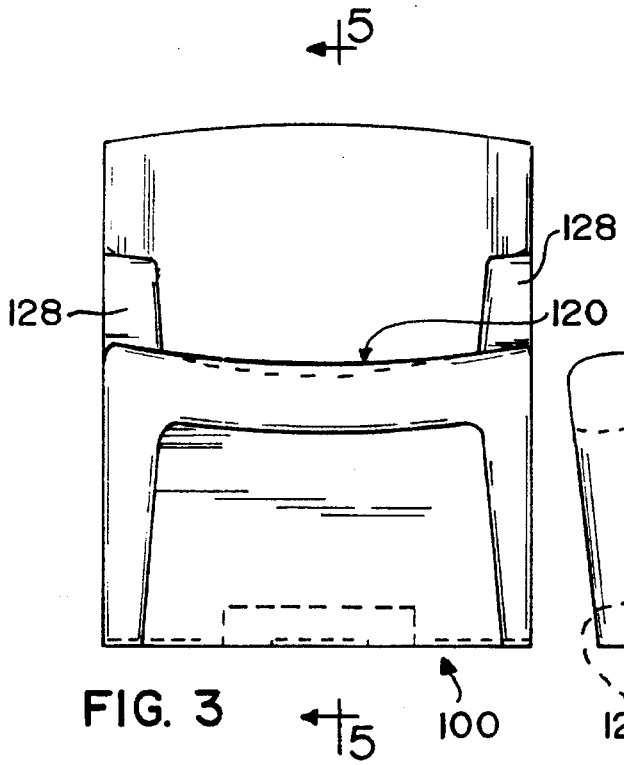
FIG. 3 depicts a front, plan view of the correctional facility chair 100 of this invention.
Figure 4:
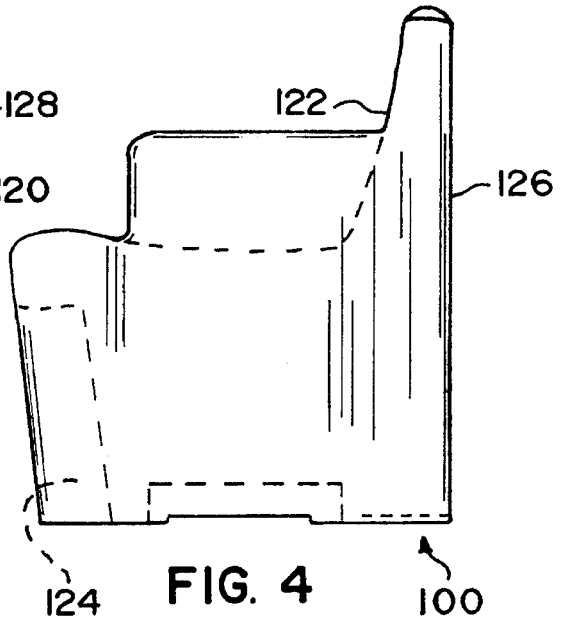
FIG. 4 depicts a side view of the correctional facility chair 100 of this invention.

With the additional consideration of FIG. 3, and FIG. 4, chair 100 includes an ergonomically shaped seat 120 and an ergonomically shaped back 122 along with appropriate front indentations 124 and to permit simplified molding while providing a chair 100, which is strong, durable and comfortable. The chair 100 has a back 126, combined with a pair of oppositely-disposed arm rests 128, each being perpendicular to opposing edges of the back 122 and seat 120.

Figure 5:
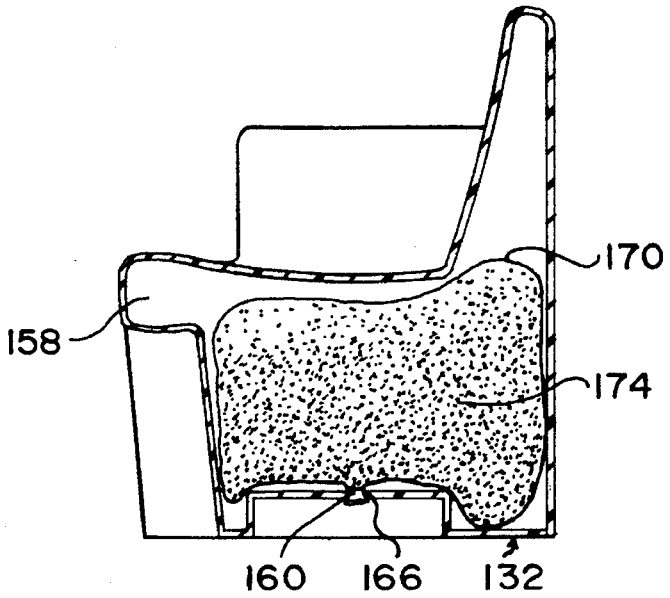
FIG. 5 depicts a side view of the correctional facility chair 100 of this invention, in partial cross-section.

The concept of adding weight to the chair 100 is shown in FIG. 5. Centrally located in the base 132 of the chair 100 for providing access to the interior 158 of chair 100 is a plug 160. Plug 160 serves as a closure member for base aperture 166 in the base 132 of chair 100.

Into that base aperture 166 may be inserted a bag 170. The bag 170 may have sand 174, or a similar material inserted therein. The bag 170 may then be sealed and the plug 160 used to close base aperture 166. This sand 174 or similar heavy material can provide weight to the chairs 100 and make the chair 100 difficult, if not impossible, to move. In this fashion, the desired results can be obtained for a chair 100 or group thereof suitable for use in an incarceration facility.

The formation of the aperture 166 in the base 132 of the chair 100 permits access to the interior 158 of chair 100. Such access permits the bag 170 to be inserted into the interior 158 of chair 100 if it is so desired. The bag 170, while optional, adds to the neatness desired for the system using chair 100. Thus, chair 100 or group thereof can be made heavy at the desired site of use in this manner.

Whether there is a bag 170 in the interior or not, a flowable material capable of providing great weight when contained may be added to the chair 100. Typical of the flowable material is sand or other weighty material. It is also feasible to insert the sand or other weighty material directly into the chairs 100. However, the bag 170 is preferred especially with sand with the idea being neatness and more efficient insertion of the sand.

Figure 6:
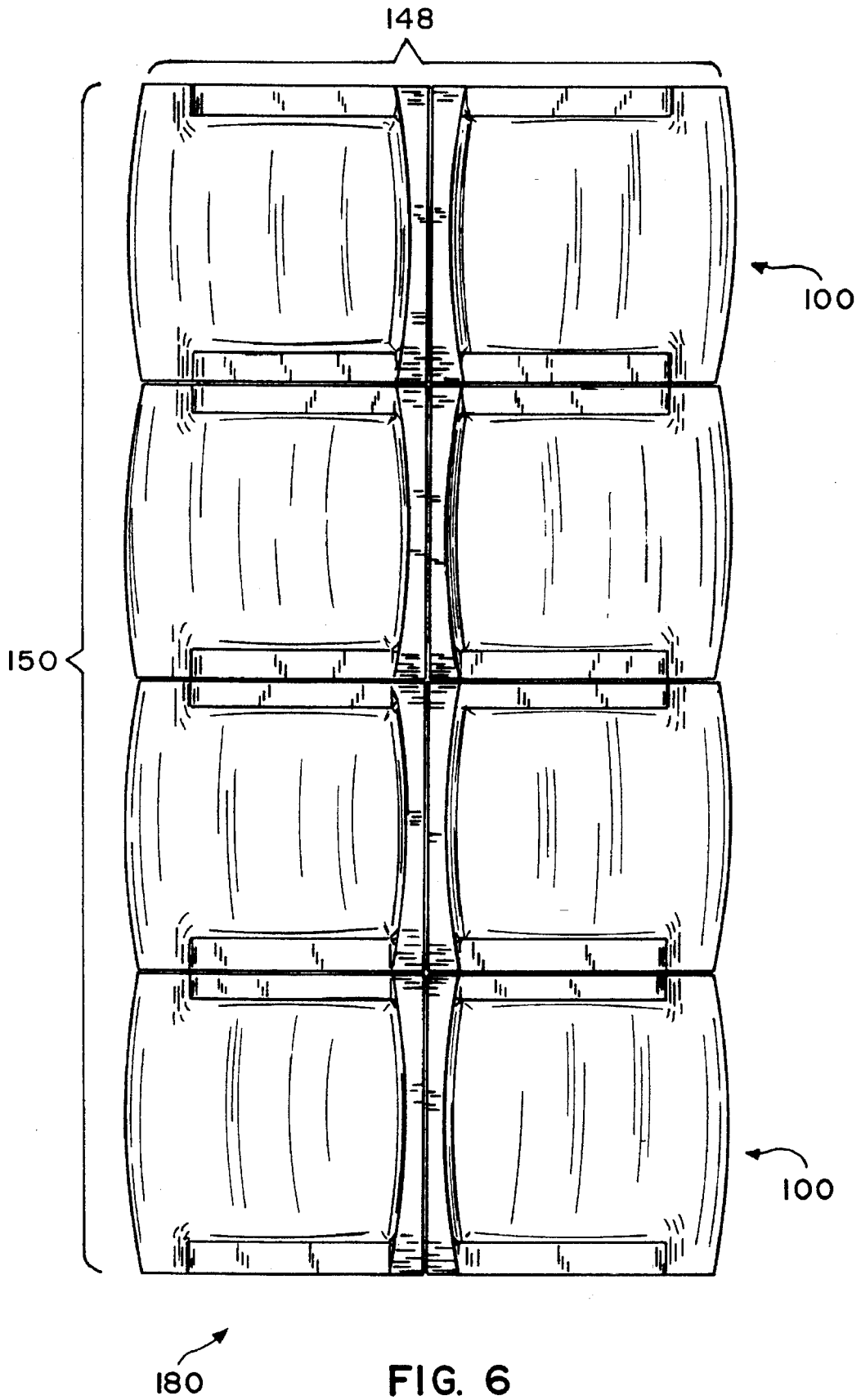
FIG. 6 depicts a top, plan view of eight correctional facility chairs 100 of this invention

Clearly, with the consideration of FIG. 6, as many of chair 100 as desired may be placed and joined in side to side structure 150. Back to back structure 148 is clearly limited to two chairs 100. The eight group 180 shown herein is illustrative only. Side to side structure 150 and back to back structure 148 may be used jointly or severally.

Figure 7:
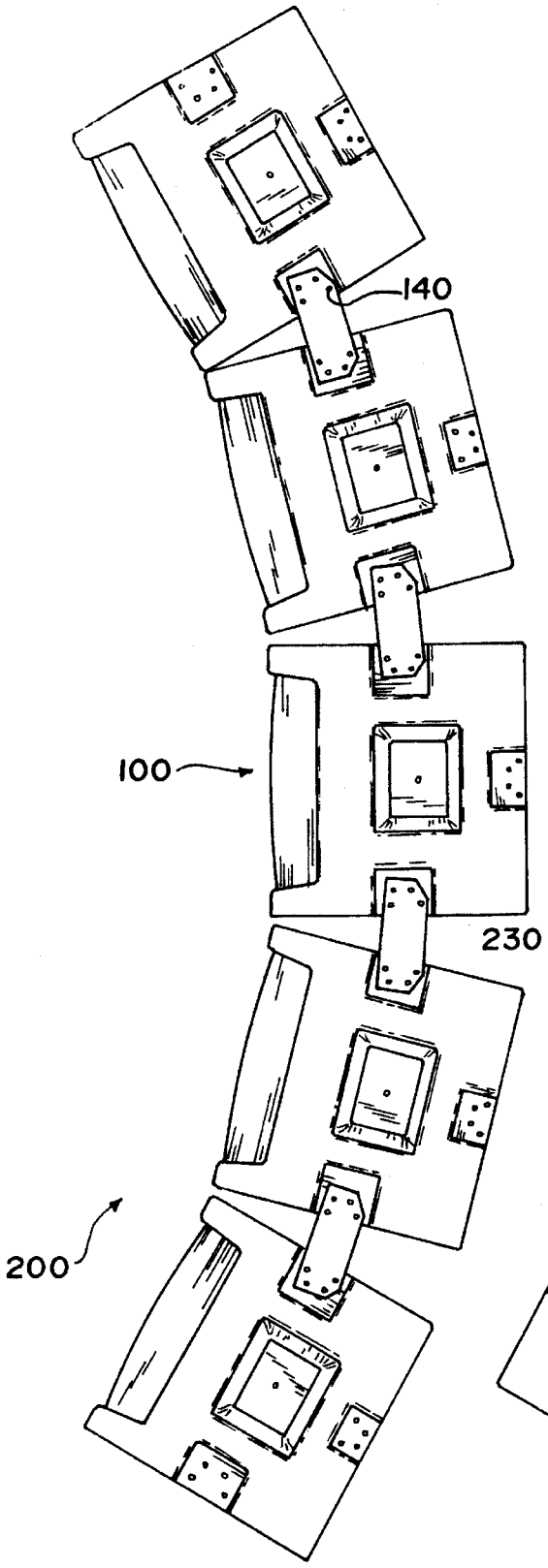
FIG. 7 depicts a bottom, plan view of five correctional facility chairs 100 of this invention showing an interior arc 200.

As shown in FIG. 7, an interior arc 200 can be formed from the correctional facility chair 100. By interior arc 200 is meant that the seat 120 of the chair 100 faces inwardly. Arc plate 230 of FIG. 9 is adjusted in shape to fit first side indentation 136 and second side indentation 138 slidably and movably as opposed to the snug fit of straight plate 142 therein.

Figure 8:
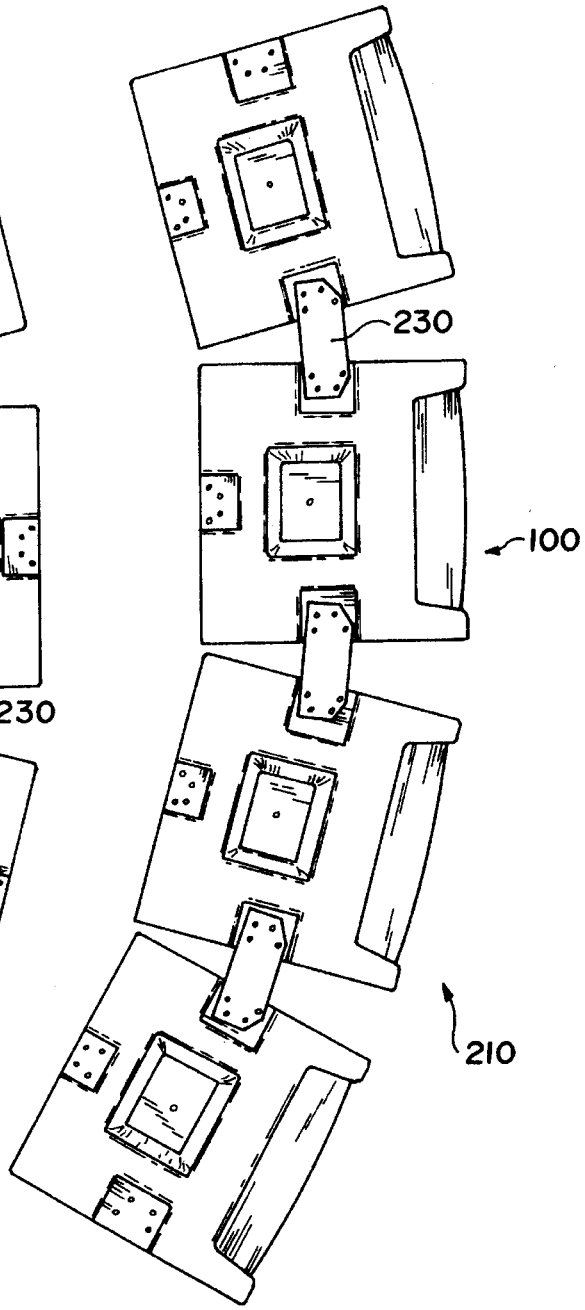
FIG. 8 depicts a bottom, plan view of four correctional facility chairs 100 this invention showing an exterior arc 210.

Plate apertures 140 are sufficient to provide the interior arc 200 as desired. In fact plate apertures 140, may be provided in sufficient number to provide for a variety of different angles for interior arc 200. Arc plate 230 is movable within first side indentation 136 and second side indentation 138 and rear indentation 134 due to the size of arc plate 230, The exterior arc 210 of FIG. 8 is formed by merely having arc plate 230 turned over with a different flat side down. The variations of exterior arc 210 are similar to interior arc 200. By exterior arc 210 is meant that the seat 120 of the chair 100 faces outwardly.

Figure 9:
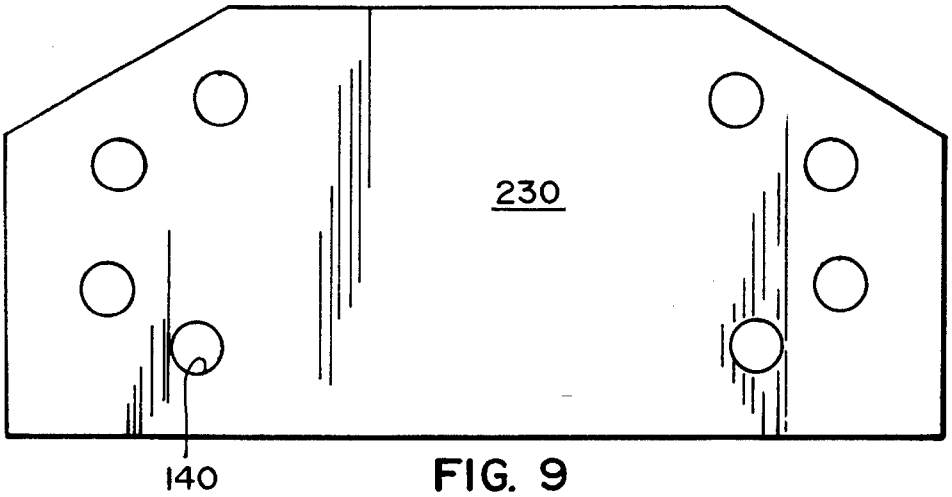
FIG. 9 depicts a top, plan view of arc plate 230.

In FIG. 9, arc plate 230 is shown as having a series of plate apertures 144 for each female threaded member 140. Each plate aperture 144 in arc plate 230 can align with and be connected to a female threaded member 140. By appropriate selection of a plate aperture 144 in arc plate 230, interior arc 200 can be adjusted with respect to both the angle and the shape, thereof.

By turning over arc plate 230, exterior arc 210 can be achieved in the same fashion and with similar adjustments as interior arc 200. Optionally additional plate apertures 144 can be applied to avoid turning arc plate 230 over. Apertures 144 must not however weaken the arc plate 230. The appropriate strength of arc plate 230 can be empirically determined.

Figure 10:
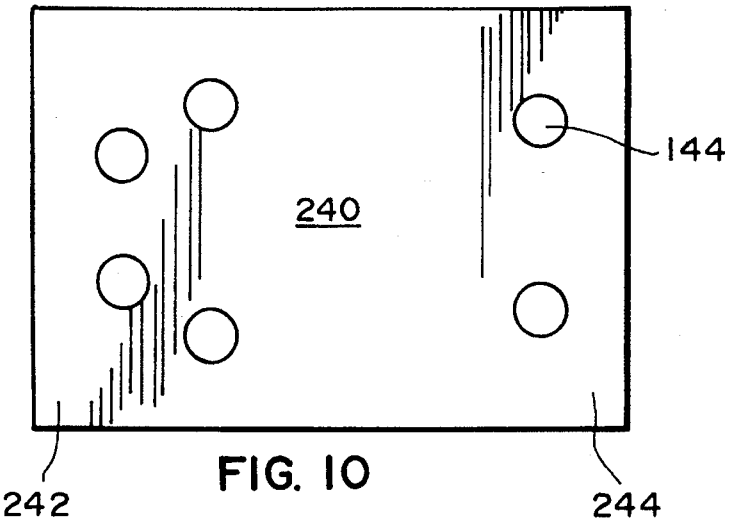
FIG. 10 depicts a top, plan view of floor plate 240.

Floor plate 240 of FIG. 10 is shorter in length than either straight plate 142 or arc plate 230. Floor plate 240 has a chair portion 242, which fits under chair 100, and an extension portion 244, which extends outwardly from the chair 100 as shown in FIG. 1. Floor plate 240 includes plate apertures 144 in extension portion 244 securing the chair 100 to the floor.

Figure 11:
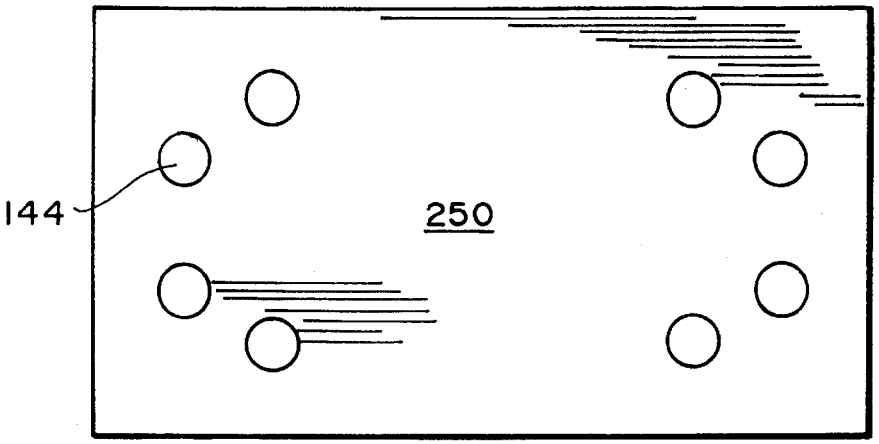
FIG. 11 depicts a top, plan view of combination plate 250.

FIG. 11 depicts combination plate 250 as having sufficient apertures 144 to be substituted for any one of floor plate 240, arc plate 230 or straight plate 142. The apertures 144 and the plate shape are the clear reasons for this versatility.

This application—taken as a whole with the claims, specification, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A chair assembly comprising:

a) a first and a second shaped, one-piece chair form each having a pair of oppositely disposed arms, a chair seat between the arms and a chair back support ergonomically related to the chair seat;

b) a joining means for securing the first shaped, one-piece chair form to the second shaped, one-piece chair form; wherein each of the shaped one-piece chair forms includes:

c) a means for adding weight thereto;

d) a base below the chair seat;

e) the joining means being situated in the base;

f) the means for adding weight being situated in the base;

g) the pair of oppositely disposed arms including a first arm and a second arm;

h) the joining means including a set of indentations;

i) the set of indentations including a first indentation, a second indentation and a third indentation;

j) the first indentation being near the first arm;

k) the second indentation being near the second arm;

l) the third indentation being near the chair back support;

m) the first indentation, the second indentation, and the third indentation each having at least one threaded member secured therein; and n) the first indentation, the second indentation, and the third indentation each receiving a plate.

2. The chair assembly claim 1 comprising:

a) the first indentation, the second indentation, and the third indentation each having at least three threaded members secured therein;

b) the plate being a full-sized plate; and c) the full-sized plate including at least one aperture capable of alignment with one of the at least three threaded members.

3. The chair assembly of claim 1 comprising:

a) the first indentation, the second indentation, and the third indentation each having at least three threaded members secured therein;

b) the plate being a full-sized plate;

c) the full-sized plate being of sufficient size to fit tightly in one member of the set of indentations;

d) the full-sized plate being of sufficient size to extend beyond the one member of the set of indentations; and e) the full-sized plate including at least one aperture capable of alignment with one of the at least three threaded members.

4. The chair assembly of claim 1 comprising:

a) the first indentation, the second indentation, and the third indentation each having at least three threaded members secured therein;

b) the plate being a half plate;

c) the half plate being of sufficient size to fit in one member of the set of indentations;

d) the half plate being of sufficient size to extend beyond the one member of the set of indentations;

e) the half plate including at least one aperture capable of alignment with one of the at least three threaded members; and f) the half plate including at least one aperture extending beyond the one member of the set of indentations to be used for securing the plate and the shaped, one-piece chair to a floor.

5. The chair assembly of claim 1 comprising:

a) the means for adding weight being a closable aperture situated in the base;

b) and a closing means for the closable aperture.

6. The chair assembly claim 5 further comprising:

a) a bag being situated within the shaped, one piece chair;

b) the closable aperture receiving the bag therethrough;

c) a flowable, weight-adding material within the shaped, one-piece chair and the bag; and d) the flowable, weight-adding material being sand.

7. The assembly chair of claim 1 comprising:

a) the first indentation, the second indentation, and the third indentation each having at least three threaded members secured therein;

b) the plate being a movable plate; and c) the movable plate including at least one aperture capable of alignment one of the at least three threaded members.

8. The chair assembly of claim 7 comprising:

a) the movable plate being of sufficient size to fit movably in one member of the set of indentations until secured therein; and b) the movable plate being of sufficient size to extend beyond the one member of the set of indentations.

9. An assembly of at least two shaped, one-piece chair forms comprising:

a) the at least two of the shaped, one-piece forms each having a pair of oppositely disposed arms, a chair seat between the arms and a chair back support ergonomically related to the chair seat;

b) the at least two of the shaped, one-piece chairs forming a first chair and a second chair;

c) a joining means for securing the first chair to the second chair; and d) a means for adding weight to the first chair and to the second chair;

f) the first chair being similar in shape to the second chair;

g) the joining means being situated in a base of the first chair;

h) the means for adding weight being situated in the base of the first chair;

i) the pair of oppositely disposed arms of the first chair including a first arm and a second arm;

j) the joining means including a set of indentations;

k) the set of indentations including a first indentation, a second indentation and a third indentation;

l) the first indentation being near the first arm if the first chair;

m) the second indentation being near the second arm of the first class;

n) the third indentation being near the chair back support of the first chair;

o) the first indentation, the second indentation, and the third indentation each having at least one threaded member secured therein; and p) the first indentation, the second indentation, and the third indentation each receiving a plate.

10. The assembly of claim 9 comprising:

a) the means for adding weight being a closable aperture situated in the base;

b) the closable aperture receiving a flowable, weight-adding material to render chair substantially immobile; and c) a closing means for the closable aperture.

11. The assembly of claim 10 comprising:

a) the closable aperture receiving a bag to receive the flowable, weight-adding material and to be within the chair; and b) the flowable, weight-adding material being sand.

12. The assembly of claim 9 comprising:

a) a base below the chair seat of the second chain;

b) joining means being situated in the base of the second chair; and c) means for adding weight being situated in the base of the second chair.

13. The assembly of claim 12 comprising:

a) the pair of oppositely disposed arms of the second chair including a first arm and a second arm;

b) the joining means including a set of indentations;

c) the set of indentations including a first indentation, a second indentation and a third indentation;

d) the first indentation being near the first arm;

e) the second indentation being near the second arm and oppositely disposed from the first indentation; and f) the third indentation being near the chair back support of the second chair.

14. The assembly of claim 13 comprising:

a) the first indentation, the second indentation, and the third indentation each having at least one threaded member secured therein;

b) the first indentation, the second indentation, and the third indentation each receiving a plate;

c) the first indentation of the first chair being adjacent to the second indentation of the second chair;

d) the plate being of sufficient size to be secured both to the first indentation of the first chair and to the second indentation of the second chair.

15. The assembly of claim 14 comprising:

a) the first indentation of the second chair, the second indentation, and the third indentation each having at least three threaded members secured therein;

b) the plate being a full-sized plate; and c) the full-sized plate including at least one aperture capable of alignment with one of the at least three threaded members.

16. The assembly of claim 14 comprising:

a) the first indentation of the second chair, the second indentation, and the third indentation each having at least three threaded members secured therein;

b) the plate being a full-sized plate;

c) the full-sized plate being of sufficient size to fit tightly in one member of the set of indentations;

d) the full-sized plate being of sufficient size to extend beyond the one member of the set of indentations; and e) the full-sized plate including at least one aperture capable of alignment with one of the at least three threaded members.

17. The assembly of claim 14, comprising:

a) the first indentation of the second chair, the second indentation, and the third indentation each having at least three threaded members secured therein;

b) the plate being a half plate;

c) the half plate being of sufficient size to fit in one member of the set of indentations;

d) the half plate being of sufficient size to extend beyond the one member of the set of indentations;

e) the half plate including at least one aperture capable of alignment with one of the at least three threaded members; and f) the half plate including at least one aperture extending beyond the one member of the set of indentations to be used for securing the plate and the second chair to a floor.

18. The assembly of claim comprising:

a) the first indentation of the second chair, the second indentation, and the third indentation each having at least three threaded members secured therein;

b) the plate being a movable plate; and c) the movable plate including at least one aperture capable of alignment one of the at least three threaded members.

19. The assembly of claim 18 comprising:

a) the movable plate being of sufficient size to fit movably in one member of the set of indentations until secured therein; and b) the movable plate being of sufficient size to extend beyond the one member of the set of indentations.

* * * * *

UNITED STATES PATENT AND TRADEMARK OFFICE

CERTIFICATE OF CORRECTION

PATENT NO. : 5,496,091

DATED : March 5, 1996

INVENTOR(S) : Richard B. Karl, St. Charles; Harvey Hanig, North Aurora, both of Illinois

It is certified that error appears in the above-identified patent and that said Letters Patent is hereby corrected as shown below:

In Column 1, at Line 16, please replace "an correctional" with --a correctional--.

In Column 1, at Line 62 the last line, please replace "chair Thus" with --chair. Thus--.

In Column 4, at Line 27, please replace "150 is" with --150 are--.

In Column 7, at Line 3, please replace "assembly claim" with --assembly of claim--.

In Column 7, at Line 15, please replace "alignment one" with --alignment with one--.

In Column 7, at Line 45, please replace "if" with --of--.

In Column 7, at Line 48, please replace "class" with --chair--.

UNITED STATES PATENT AND TRADEMARK OFFICE

CERTIFICATE OF CORRECTION

PATENT NO. : 5,496,091

DATED : March 5, 1996

INVENTOR(S) : Richard B. Karl, St. Charles; Harvey Hanig, North Aurora, both of Illinois It is certified that error appears in the above-identified patent and that said Letters Patent is hereby corrected as shown below:

In Column 8, at Line 7, please replace "chain;" with --chair;--.

In Column 9, at Line 7, please replace "claim comprising" with --claim 14 comprising--.

Signed and Sealed this

Second Day of December, 1997

*Attest:*

*Attesting Officer*

Bruce Lehman

BRUCE LEHMAN

*Commissioner of Patents and Trademarks*